US006729241B2

(12) United States Patent
Gabriel et al.

(10) Patent No.: US 6,729,241 B2
(45) Date of Patent: May 4, 2004

(54) AERIAL CABLEWAY SYSTEM WITH AT LEAST ONE LOAD-BEARING AND CONVEYING CABLE MOVING BETWEEN A VALLEY STATION AND A MOUNTAIN STATION

(75) Inventors: Gerhard Gabriel, Schwarzach (AT); Herbert Dür, Schwarzach (AT); Gerd Dür, Bildstein (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 10/439,737

(22) Filed: May 16, 2003

(65) Prior Publication Data

US 2004/0011240 A1 Jan. 22, 2004

(30) Foreign Application Priority Data

Jul. 16, 2002 (AT) ..... 1063/2002

(51) Int. Cl.[7] ..... B61B 15/00

(52) U.S. Cl. ..... 104/173.1; 104/28; 105/149.1; 105/149.2

(58) Field of Search ..... 104/27, 28, 30, 104/173.1, 173.2, 178, 179, 180; 105/149.1, 149.2

(56) References Cited

U.S. PATENT DOCUMENTS 3,347,173 A * 10/1967 Carlevaro ..... 104/173.2
4,391,200 A * 7/1983 Bajulaz ..... 104/20
4,784,065 A * 11/1988 Brochand ..... 104/173.2
5,172,640 A * 12/1992 Cathiard ..... 104/173.2
5,213,048 A * 5/1993 Kunczynski ..... 105/149.2
5,383,407 A * 1/1995 Souchal ..... 105/149.1
5,454,326 A * 10/1995 Goirand ..... 104/28
6,427,601 B2 * 8/2002 Albrich ..... 104/87

* cited by examiner

*Primary Examiner*—Mark T. Le
(74) *Attorney, Agent, or Firm*—Laurence A. Greenberg; Werner H. Stemer; Gregory L. Mayback

(57) ABSTRACT

An aerial cableway system has at least one load-bearing and conveying cable that is moved between a valley station and a mountain station, which is guided over deflection pulleys in the stations, and transportation devices that can be coupled to the load-bearing and conveying cable and that are formed by cabins and by chairs. The cabins and chairs can be uncoupled from the conveying cable in the stations, moved along guide rails through entry and exit regions located in the stations, and then once more coupled to the conveying cable. The entry and exit regions provided in the stations are respectively subdivided into two mutually separate sectors which follow each other in the direction of movement. A first sector is intended for the users of the cabins and a second sector is provided for the users of the chairs.

8 Claims, 3 Drawing Sheets

AERIAL CABLEWAY SYSTEM WITH AT LEAST ONE LOAD-BEARING AND CONVEYING CABLE MOVING BETWEEN A VALLEY STATION AND A MOUNTAIN STATION

BACKGROUND OF THE INVENTION

Field of the Invention

The present invention relates to a cableway system (also referred to as a cable railroad system, a ropeway system, aerial tramway, etc.) having at least one load-bearing and conveying cable that can be moved between a valley station and a mountain station. The cable is guided over deflection pulleys in the stations, and it supports transportation devices that can be coupled to the load-bearing and conveying cable and that are formed by cabins and by chairs. The transportation device can be uncoupled from the conveying cable in the stations, moved along guide rails through entry and exit regions located in the stations and then once more coupled to the conveying cable.

It has been known to equip aerial cableway systems either with chairs or with cabins. The chairs are thereby generally used to convey skiers from a lower station (the valley station) to a higher station (the mountain station). Cabins are primarily used to convey snowboarders, walkers and other persons without skis strapped to their feet from the valley station to the mountain station or from the mountain station to the valley station.

Access for the skiers to the entry point is generally effected through an access barrier, which is opened as soon as a chair is moved through the valley station. The skiers enter the boarding region via a slightly inclined ramp and the relevant chair approaches the skiers from behind. After the skiers sit down on the chair, they are conveyed out of the boarding region.

Access for users to the aerial cableway system without skis is typically effected via a platform, along which the cabins are moved. The passengers waiting on the platform are able to enter the moving cabins.

It has also further been proposed to equip aerial cableway systems both with chairs and with cabins, chairs and cabins being coupled alternately to the load-bearing and conveying cable. In this case, the numbers of chairs, on the one hand, and of cabins, on the other hand, depend on the numbers of skiers and the other passengers. In such a aerial cableway system, however, there is the difficulty that, because of the different types of continuous movement of the skiers, on the one hand, and of the nonskiers, on the other hand, these can hamper one another or only the requirements of one type of user can be met.

SUMMARY OF THE INVENTION

It is accordingly an object of the invention to provide a cableway system, which overcomes the above-mentioned disadvantages of the heretofore-known devices and methods of this general type and which allows both skiers and persons who have not strapped on any skis to be conveyed without difficulties during embarking and disembarking the transportation devices, because of the different types of continuous movement of these two groups.

With the foregoing and other objects in view there is provided, in accordance with the invention, an aerial cableway system, comprising:

a valley station and a mountain station each having a deflection pulley and guide rails;

a load-bearing and conveying cable disposed to move between said valley station and said mountain station and to be guided over said deflection pulleys in said stations;

a plurality of transportation devices including cabins and chairs each having a coupling device for coupling the respective said transportation device to said load-bearing and conveying cable, a device for uncoupling the respective said transportation device from said load-bearing and conveying cable in said stations, for moving said transportation devices along said guide rails through said stations, and for coupling the respective said transportation device to said load-bearing and conveying cable; and said stations each having an entry region and an exit region each divided into a first sector and into a second sector disposed to follow each other in a transport direction of said transportation devices, said first sector being configured for users of said cabins and said second sector being configured for users of said chairs.

In other words, the objects of the invention are achieved in that the entry and exit regions provided in the stations are respectively subdivided into two mutually separate sectors which follow each other in the direction of movement, a first sector being intended for the users of the cabins and a second sector is intended for the users of the chairs.

The first sector of the entry and exit region in the valley station is preferably located before the second sector, in the direction of movement of the traction operating means. According to further preferred features, the second sector of the exit region for the skiers in the mountain station is located before the first sector of the exit and entry region for the non skiers, in the direction of movement of the traction operating means. In addition, the sectors of the entry regions are preferably accessible via respectively associated access barriers. Furthermore, the opening of the access barriers in the two sectors can be controllable as a function of the type of traction operating means respectively moving into the relevant sector. In particular, the access barrier for the second sector located in the valley station can be controllable in a manner known per se as a function of the movement of the chairs.

Furthermore, equipment is preferably provided in the valley station and in the mountain station by means of which the opening and closing of the doors of the cabins in the first sectors of the entry and exit regions and the opening and closing of covering hoods of the chairs can be effected.

Other features which are considered as characteristic for the invention are set forth in the appended claims.

Although the invention is illustrated and described herein as embodied in a aerial cableway system having at least one load-bearing and conveying cable that can be moved between a valley station and a mountain station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
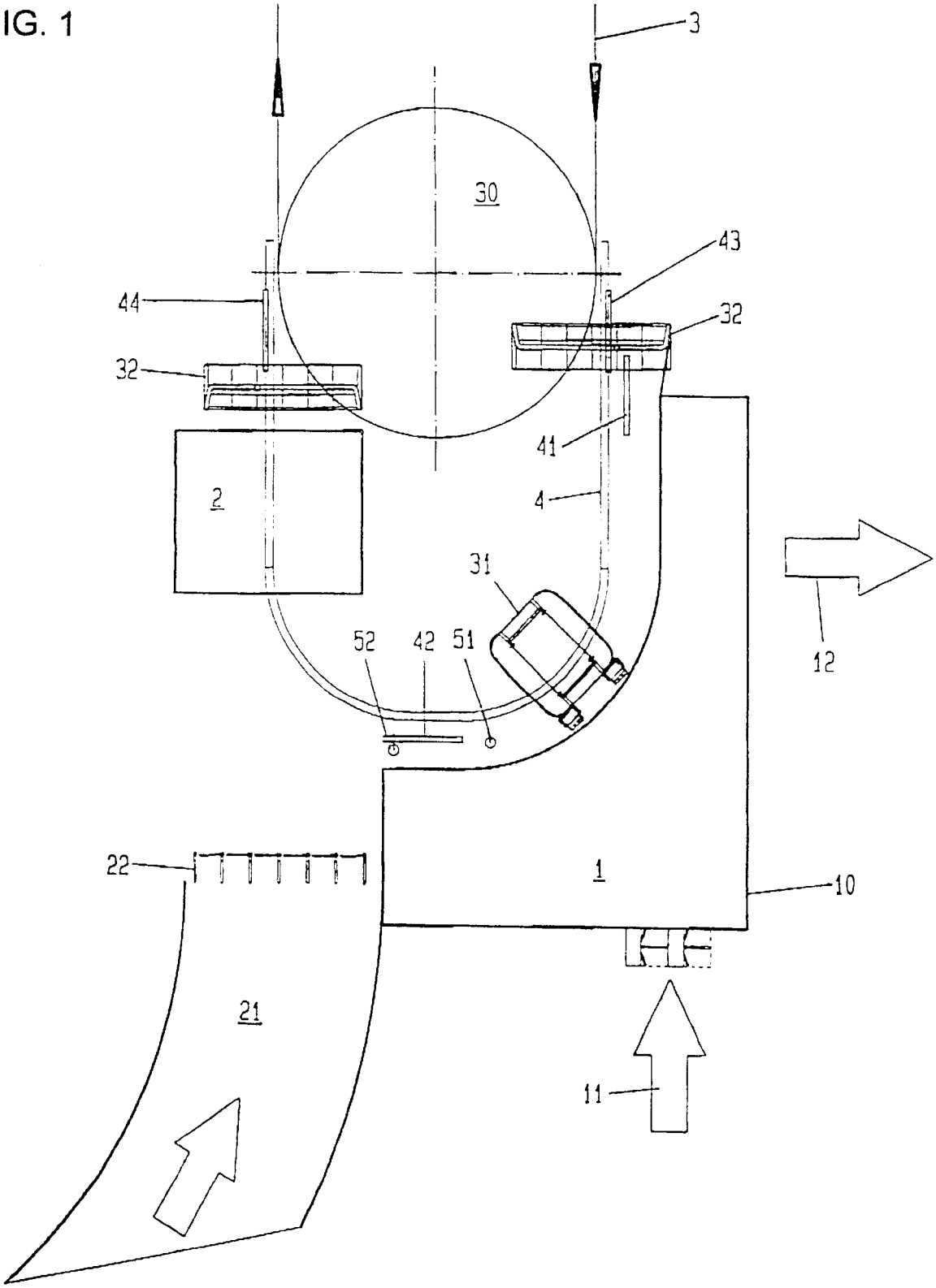
FIG. 1 is a schematic top plan view of a valley station of a aerial cableway system according to the invention.

Referring now to the figures of the drawing in detail and first, particularly, to FIG. 1 thereof, there is shown a valley station of the aerial cableway system according to the invention with a first sector 1 of the exit and entry region for those users who have not strapped on any skis, and a second sector 2 of the entry region for skiers. A load-bearing and conveying cable 3 of the aerial cableway system is guided over a deflection drum 30 in the valley station. Coupled to the load-bearing and conveying cable 3 in any desired sequence are, firstly, gondolas or cabins 31, which are provided for use by those persons who have not strapped on any skis, and, secondly, chairs 32, which are provided for use by skiers.

The cabins 31 or chairs 32 moving into the valley station, after they have been uncoupled from the load-bearing and conveying cable 3, are moved along a guide rail 4 at a speed of about 0.25 m/s, which is reduced with respect to the speed of the load-bearing and conveying cable 3, it being possible for them to be boarded and left by passengers.

For this purpose, in the direction of movement of the load-bearing and conveying cable 3, the first sector 1 of the exit and entry region is provided, and is formed by a platform 10 which can be entered via an access 11 and on which the non-skiers wait for the cabins 31 moving into the valley station. The platform and the cabins 31 are, of course, also available to skiers who carry their skis. Assigned to the cabins 31 at the entry into the valley station is a first device 41, by means of which their doors are opened. Passengers in the cabin 31 arrive on the platform 10 and can leave the latter via an exit 12. As a result, passengers waiting on the platform 10 can board the cabin 31. At the end of the platform 10, a second device 42 is provided, by means of which the doors of the cabin 31 are closed. After the cabin 31 has been moved through the valley station along the guide rail 4, it is once more coupled to the load-bearing and conveying cable 3.

In an analogous way, the chairs 32 entering the valley station are also uncoupled from the load-bearing and conveying cable 3 and moved through the valley station along the guide rail 4. A third device 43 is provided in the region of the entry to the valley station by way of which the covering hoods of the chairs 32, if present, are moved into their open position. The chairs 32 are moved through the first sector 1 of the entry region and are moved toward the second sector 2. The skiers pass via an entry 21 and through an access gate or access barrier 22 controlled by the movement of the chairs 32 into the second sector 2, wherein the chairs 32 approach the skiers from behind, whereupon the latter can sit on the chairs 32. A fourth device 44 is provided in the exit region, by way of which the covering hoods of the chairs 32 are then automatically moved into their closed position if the chairs 32 are not occupied. The chairs 32 are then coupled onto the load-bearing and conveying cable 3 and they are slaved up to the mountain station. In the region of the track of the traction operating means there is additionally a first sensor 51, by means of which the access barrier 22 is opened as a chair 32 passes by, and a second sensor 52, which checks that the doors of the cabins 31 are in their closed position.

Since the cabins 31 and the chairs 32 are moved through the first sector 1 at a speed of about 0.25 m/s, the cabins 31 can be boarded by the passengers waiting on the platform 10.

Figure 1A:
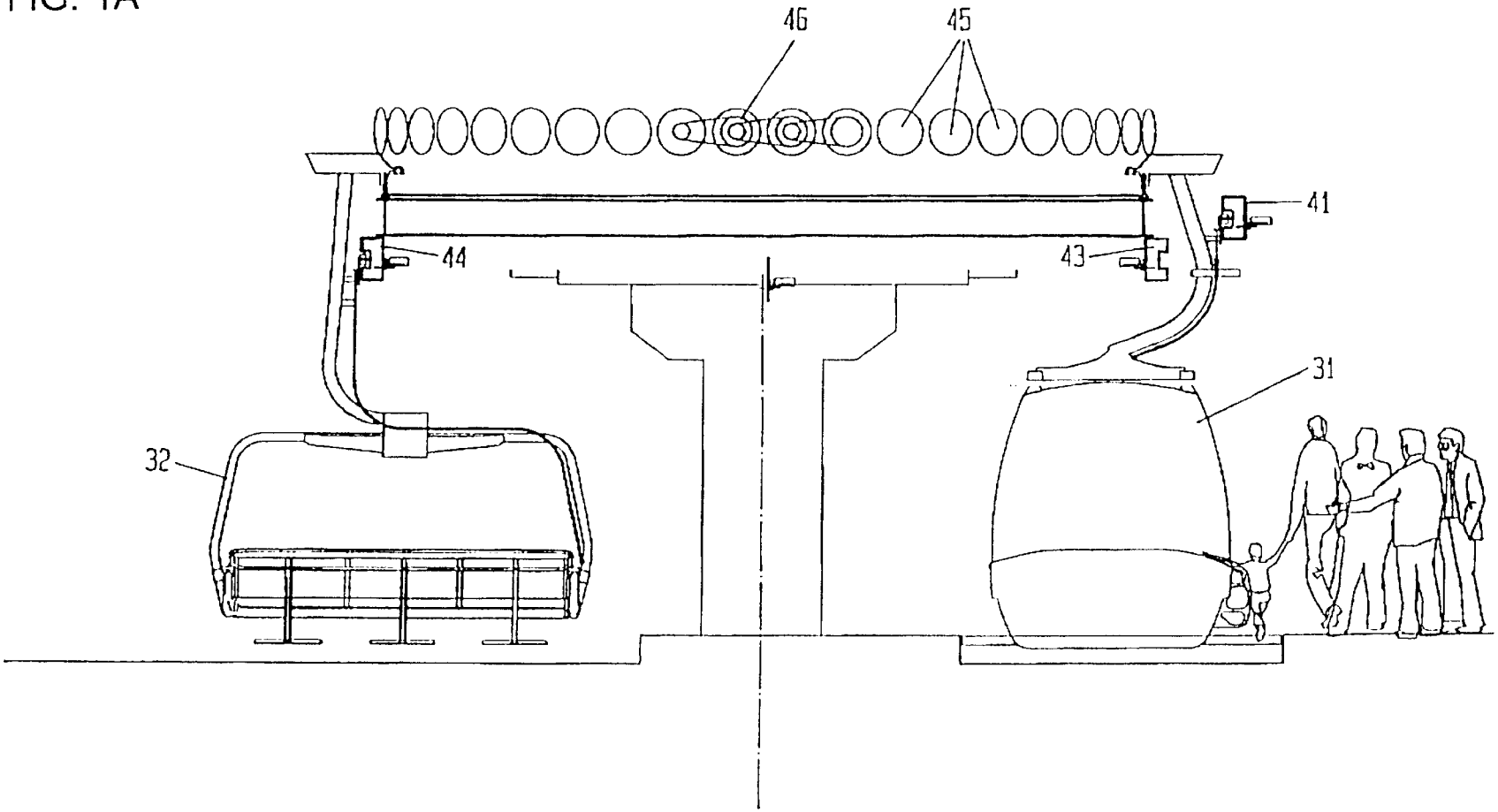
FIG. 1A is a front elevational view of the valley station of the aerial cableway system according to FIG. 1.

As additionally indicated in FIG. 1A, the conveying wheels 45 provided in the region of the valley station are provided with step-up transmissions 46, by means of which the speed of the cabins 31 and of the chairs 32, after these have left the first sector 1 of the entry region, is increased to about 1 m/s. Accordingly, the chairs 32 in the second sector 2 are moved toward the skiers at the higher speed. As a result of the increase in the conveying speed, the distance between the individual transportation devices 32 and 31 is increased.

Figure 2:
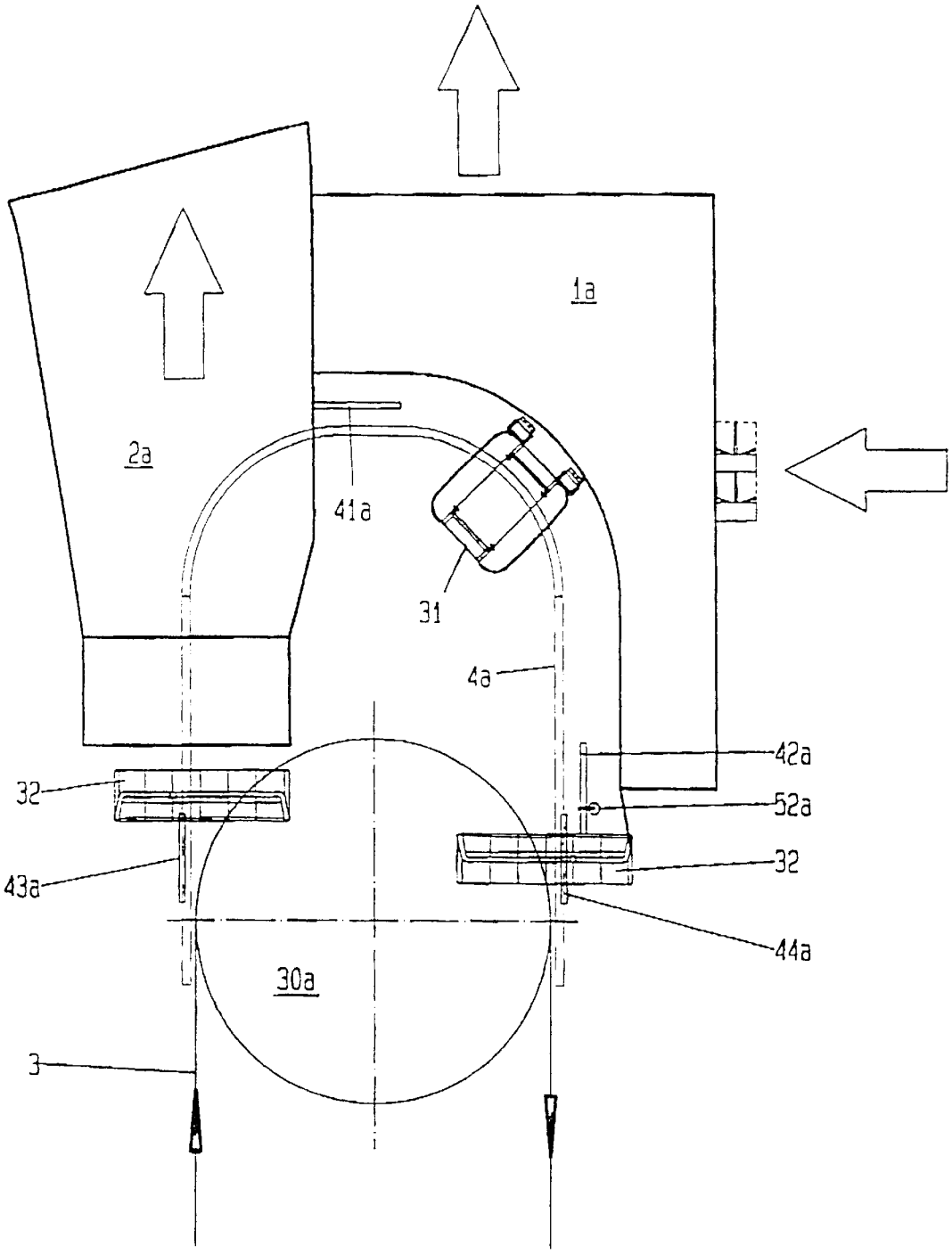
FIG. 2 is a schematic top plan view of a mountain station of the aerial cableway system according to the invention.

As can be seen from FIG. 2, in the mountain station there is a constructional configuration which largely corresponds to that of the valley station. In the mountain station, the load-bearing and conveying cable 3 is also guided over a deflection pulley 30*a*, the cabins 31 and chairs 32, after being uncoupled from the load-bearing and conveying cable 3, are moved through the mountain station along a guide rail 4*a*, and likewise equipment 41*a*, 42*a*, 43*a*, 44*a* for opening and closing the doors of the cabins 31 and covering hoods of the chairs 32 is provided.

Differing from the valley station, however, the sequence of the sectors 2*a* for the exit of the skiers from the chairs 32 and the exit of the non skiers from the cabins 31 and the following boarding of the non skiers into the cabins 31, in the direction of movement of the cabins 31 and of the chairs 32, is arranged in such a way that the sector 1*a* for the non skiers is located after the sector 2*a* for the exit of the skiers, in the direction of movement of the load-bearing and conveying cable 3.

However, since it is only critical that the sectors 1 and 1*a* and 2 and 2*a* of the entry regions and the exit regions for the non skiers and for the skiers are arranged to follow each other in the direction of movement of the cabins 31 and the chairs 32, in order to ensure that the two groups of passengers who move onward in a different manner do not hamper one another, there is no absolute restriction in this regard.

We claim:

1. An aerial cableway system, comprising:

a valley station and a mountain station each having a deflection pulley and guide rails;

a load-bearing and conveying cable disposed to move between said valley station and said mountain station and to be guided over said deflection pulleys in said stations;

a plurality of transportation devices including cabins and chairs each having a coupling device for coupling the respective said transportation device to said load-bearing and conveying cable, a device for uncoupling the respective said transportation device from said load-bearing and conveying cable in said stations, for moving said transportation devices along said guide rails through said stations, and for coupling the respective said transportation device to said load-bearing and conveying cable; and said stations each having an entry region and an exit region each divided into a first sector and into a second sector disposed to follow each other in a transport direction of said transportation devices, said first sector being configured for users of said cabins and said second sector being configured for users of said chairs.

2. The aerial cableway system according to claim 1, wherein, in said valley station, said first sector of said entry and exit region for users of said cabins is disposed before said second sector for users of said chairs, in the transport direction of said transportation devices.

3. The aerial cableway system according to claim 1, wherein, in said mountain station, said second sector of said exit region for users of said chairs is disposed before said first sector of said exit and entry region for users of said cabins, in the transport direction of said transportation devices.

4. The aerial cableway system according to claim 1, which comprises access barriers disposed to selectively allow access to said sectors of said entry regions.

5. The aerial cableway system according to claim 4, wherein a respective said access barrier is opened in dependence on a given type of said transportation devices respectively moving into a corresponding sector.

6. The aerial cableway system according to claim 1, wherein said access barrier for said second sector disposed in said valley station is controlled in dependence on a movement of said chairs.

7. The aerial cableway system according to claim 1, which comprises a plurality of devices disposed in said valley station and in said mountain station for opening and closing doors of said cabins in said first sectors of said entry and exit regions.

8. The aerial cableway system according to claim 7, which comprises a plurality of devices disposed in said valley station and in said mountain station for opening and closing covering hoods of said chairs in said valley station and in said mountain station.

* * * * *